United States Patent [19]

Marin et al.

[11] 4,027,124

[45] May 31, 1977

[54] CONTACT SYSTEM FOR HIGH-VOLTAGE POWER CIRCUIT BREAKERS

[75] Inventors: Heiner Marin; Alfred Müller, both of Berlin, Germany

[73] Assignee: Siemens Aktiengesellschaft, Munich, Germany

[22] Filed: Aug. 1, 1974

[21] Appl. No.: 493,898

[30] Foreign Application Priority Data

Aug. 2, 1973 Germany ..... 2339553

[52] U.S. Cl. ..... 200/146 R; 200/148 R

[51] Int. Cl.² ..... H01H 33/12

[58] Field of Search ..... 200/146 R, 148 R, 148 D

[56] References Cited

UNITED STATES PATENTS

| | | | |
|---|---|---|---|
| 3,835,274 | 9/1974 | Marin | 200/146 R |
| 3,848,101 | 11/1974 | Eberhard et al. | 200/146 R |
| 3,855,437 | 12/1974 | Goedecke et al. | 200/148 R |

*Primary Examiner*—Robert S. Macon

*Attorney, Agent, or Firm*—Kenyon & Kenyon Reilly Carr & Chapin

[57] ABSTRACT

A contact system for high-voltage power circuit breakers which includes at least one stationary, hollow, nozzle-shaped contact, comprising an electrically conducting tube made from copper or copper alloy and a nozzle body of arc-resistant material, such as graphite which is joined to the tube at the end face thereof. In the closed position the stationary contact is surrounded by a movable, tubular switching member with resiliently supported contact elements. The nozzle body has a larger outside diameter in the region of the joint compared with the diameter of the tube. When the switching member is drawn across the joint, the larger diameter of the nozzle body results in an increased pressure being applied thereto by the resilient contact members. Because of the characteristics of graphite the increased pressure results in a reduction of the resistance of graphite thereby improving the commutation of electric current from the tube to the nozzle and reducing the tendency to arc.

4 Claims, 2 Drawing Figures

CONTACT SYSTEM FOR HIGH-VOLTAGE POWER CIRCUIT BREAKERS

BACKGROUND OF THE INVENTION

1. Field of the Invention

This invention pertains generally to high-voltage breakers and more particularly to breakers employing a compressed-gas quenching medium.

2. Description of the Prior Art

In German Auslegeschrift 1,154,548, an electric circuit breaker is shown, wherein an electronegative, fluorine-containing gas, such as $SF_6$, is used as a quenching and insulating medium. This breaker comprises two contacts which are movable with respect to each other and between which are arc in drawn when the breaker is opened. The contacts consist of carbon, preferably graphite, which keeps the destruction of the contacts and the formation of decomposition products low during the action time of the arc. The graphite contacts are made solid and are inserted into cup-shaped electrodes. The walls of the cup-shaped electrodes partly engage undercuts in the cylinder surface of the contacts.

In the case of high-voltage power circuit breakers, particularly compressed-gas breakers, it is advantageous to make the contacts hollow annd nozzle-shaped. This facilitates the removal of the hot arc gases produced during the switching off process. The hollow contacts support at their end faces, arcing electrodes which, according to one arrangement, are made of annular shape. In this manner the contact system can satisfactorily withstand the hot arc gases.

The contact system normally includes at least one stationary, hollow, nozzle-shaped contact of arc-resistant material such as graphite, which is supported at one end thereof by an electrically conducting copper tube. In the closed position the stationary contact is surrounded by a movable, tubular switching member such as that described in U.S. Pat. No. 3,789,175. The latter includes a plurality of spring loaded contact elements which exert a spring force against the stationary contact to ensure a positive electrical connection.

One problem with the last-mentioned design occurs in opening the contacts. The spring loaded elements are drawn across the joint formed between the tube and the graphite nozzle. Because of the substantially lower conductivity of the graphite compared with that of copper, a voltage step is produced, which often times can exceed the magnitude of the cathode and anode drop. An arc develops between the copper tube and the contact elements, which causes burns at the run-off edge of the copper tube.

It is therefore a primary object of this invention to provide a stationary contact which achieves good arc resistance employing relatively simple and inexpensive means.

It is also an object of this invention to improve the commutation of the electric current from the conducting tube to the nozzle body.

SUMMARY OF THE INVENTION

For the purpose of achieving the aforementioned objects and others which will become apparent, there is described herein a contact system for high-voltage power circuit breakers which includes at least one stationary, hollow, nozzle-shaped contact, comprising an electrically conducting tube made from copper of copper alloy and a nozzle body of arc-resistant material, such as graphite, which is joined to the tube at the end face thereof. In the closed position the stationary contact is surrounded by a movable, tubular switching member with resiliently supported contact elements. The nozzle body has a larger outside diameter in the region of the joint compared with the diameter of the tube. When the switching member is drawn across the joint, the larger diameter of the nozzle body results in an increased pressure being applied thereto by the resilient contact members. Because of the characteristics of graphite the increased pressure results in a reduction of the resistance of graphite thereby improving the commutation of electric current from the tube to the nozzle.

In a preferred embodiment of the contact system according to the invention, the outside diameter of the nozzle body is at least 0.2 mm larger than the outside diameter of the tube. Generally, it is advantageous if the difference in diameters is 0.4 to 0.8 mm.

In an alternate embodiment, the switching member comprises a tulip-shaped contact arrangement and suitably disposed contact springs. The latter cooperate with the contour of the contacts to exert a progressively increasing forces on the contact elements as the switch is opened. The increasing force is generally most pronounced at the juncture of the tube and nozzle, thus enhancing the commutation.

BRIEF DESCRIPTION OF THE DRAWINGs

Reference is now made to the accompanying drawings for a better understanding of the nature and objects of the invention. The drawings illustrate the best mode presently contemplated for carrying out the objects of the invention and its principles, and are not to be construed as restrictions or limitations on its scope. In the drawings.

Figure 1:
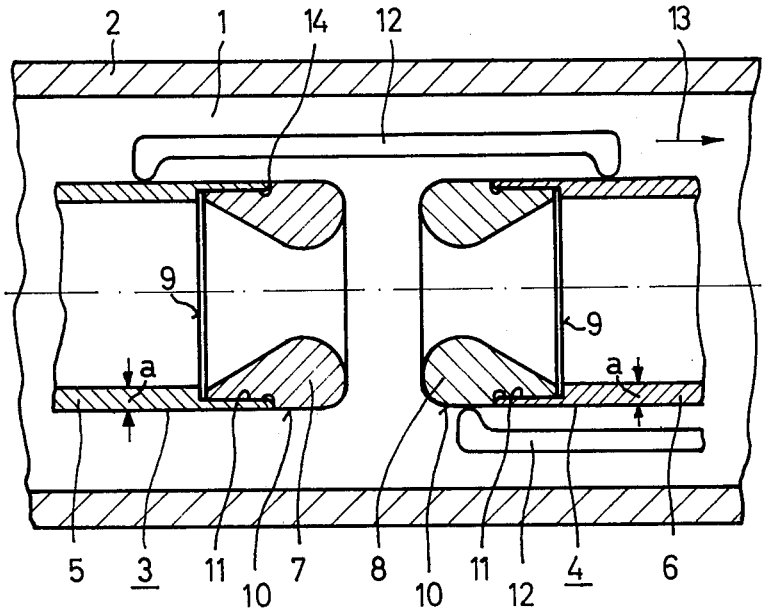
FIG. 1 shows schematically, in cross section, the contact system of an electric high-voltage power circuit breaker.

The contact system depicted in FIG. 1 is intended for use in a compressed-gas circuit breaker. The interior 1 of a switching chamber 2, which may, for instance, be made of porcelain, is filled with sulfur hexafluoride ($SE_6$) as the quenching and insulating medium. The switching chamber is of tubular design and includes two stationary, appropriately spaced contacts 3 and 4, which are essentially identical in construction. Each include an electrically conducting tube 5 or 6 which support at their end face 9 a nozzle body 7 and 8. The latter is made from an arc-resistant material, such as graphite. The two tubes 5 and 6 are made of copper or a copper alloy.

In the closed position (shown above the center line) the tubes 5 and 6 are bridged electrically by a shorting switch member 12. The design of the switching member 12 is described in U.S. Pat. No. 3,789,175. It includes an electrically conducting sleeve, against which spring-loaded contact elements are braced in such a manner that the contact fingers are pressed radially against the stationary contact. When switched to an open contact position (shown below the center line), the switching member 12 moves in the direction of the arrow 13. An arc is drawn between the graphite nozzle bodies 7 and 8. A gas-blast directs a stream of gas through the arc and into the interior of the hollow, nozzle-shaped contacts 3 and 4. This results in the extinguishment of the arc at the zero-crossing of the a-c current.

The contact tubes 5 and 6 which preferably comprise cold-worked, hardened copper each have in the area of the end faces an internal cylindrical recess, in which the nozzle body 7 or 8, respectively, is engaged, It is in the region of the joint 14 that the tendency toward arcing between the tube 3 and the switching member 12 is to be reduced through the application of the invention.

Figure 2:
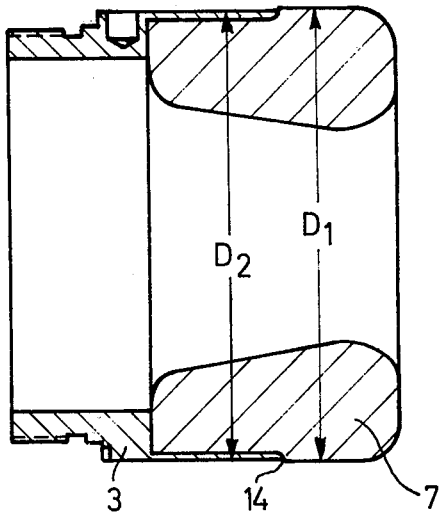
FIG. 2 shows in cross section an expanded view of the nozzle-shaped contact of the power circuit breaker of FIG. 1.

To this end, the nozzle body consisting of graphite is provided with an outside diameter $D_1$, which is larger that the outside diameter $D_2$ of the tube 3. This is seen most clearly in FIG. 2. In the example of the embodiment shown, the outside diameter $D_1$ of the nozle body 7 is at least 0.2 mm larger than the outside diameter $D_2$ of the tube. Embodiments, where the difference between $D_1$ and $D_2$ was in the order of 0.4 to 0.8 mm were also found to be satisfactory.

As the spring loaded contact elements move in the direction of arrow 13, they first pass along the outer surface of the copper tube. When they reach the joint 14, the contact elements are forced apart, as viewed in FIG. 2 by an amount equal to ½ the difference between $D_1$ and $D_2$. This increases the force on the elements which in turn is exerted on the graphite nozzle portion at the joint 14. The increased pressure on the graphite, compared to the situation where $D_1$ equals $D_2$, results in a corresponding decrease in electrical resistivity. This significantly reduces the voltage step which occurrs at the joint 14 due to the difference in the conductivities of graphite and copper. Thus, the tendency to arc is reduced and the current commutation between the two improved.

In another embodiment utilizing the principle of the invention, the switching member 12 includes a pipe-shaped contact shell in which are positioned a plurality of circumferentially disposed contact elements. The elements awre shaped and arranged such that they give the appearance of a tulip. The configuration, known in the art, is referred to as a "tulip contact" arrangement. The open end of the elements is rounded off providing a suitable contact area with the tube and nozzle. The member 12 further includes contact springs interposed between the shell and the contact elements to thereby exert a positive contact force.

During the switching-on movement, a hollow or solid switching pin positioned such that is is perpendicular to the contact area enters the opening end.

As the contact elements are drawn across the joint 14, the contact springs fixed to the contact shell, follow the contour of each tulip-shaped contact element. Thus, they exert a progressively increasing force on the contact element which in turn is transmitted to the tube and nozzle body. The springs are positioned such that this increased force is exerted, particularly, at the joint 14 thereby improving the commutation as before Other variations in the above embodiments will be apparent to those skilled in the art. The breadth of the invention is not limited to the embodiments above but must be defined in view of the claims appended hereto.

What is claimed is:

1. In a contact system for a high-voltage power circuit breaker wherein a quenching medium is utilized to quench the arc drawn when the breaker is opened, the contact system including: at least one stationary, hollow, nozzle-shaped contact member, the contact member including an electrically conducting tube and a nozzle body of arc-resistant material supported by the tube at the end-face thereof, sid nozzle body and said conducting tube conjointly defining an outer contact surface; and, a tubular switching member having resiliently supported contact elements for engaging the stationary member when the breaker is closed, the tubular switching member being movable between a first position whereat the tubular member surrounds the stationary member and said contact elements engage said outer contact surface and a second position whereat said tubular switching member and said stationary contact member conjointly define a gap across which the arc is drawn when the tubular switching member is moved from the first position to the second position to open the breaker, the improvement in said contact system comprising: said nozzle body and said conducting tube conjointly defining a joint at the region of said stationary contact member surrounded by said tubular switching member when the latter is in said first position, said nozzle body having an outer diameter $D_1$ greater than the outer diameter $D_2$ of said conducting tube at said joint thereby causing the portion of said outer contact surface corresponding to the nozzle body to be raised with respect to the portion of said outer contact surface corresponding to the conducting tube whereby the resiliently supported contact elements of said tubular switching member apply a greater contact force to said nozzle body than to said conducting tube as said contact elements are drawn across said outer contact surface with the movement of said tubular switching member.

2. The contact system of claim 1, wherein the diameter, $D_1$, is at least 0.2 mm larger than the diameter, $D_2$.

3. The contact system of claim 1, wherein the diameter $D_1$ exceeds the diameter $D_2$ by an amount in the range of 0.4 to 0.8 mm.

4. The contact system of claim 1, wherein said switching member comprises:

a. a contact shell;

b. said contact elements; and c. contact spring interposed between said shell and said contact elements, whereby said springs exert a progressively increasing force on said elements, as said elements are switched across said conducting tube and then said nozzle body.

* * * * *